US009993126B2

(12) United States Patent
Harman

(10) Patent No.: US 9,993,126 B2
(45) Date of Patent: Jun. 12, 2018

(54) DUAL PORT VALVE ASSEMBLY AND RETRACTABLE HOSE CENTRAL VACUUM CLEANING SYSTEM

(76) Inventor: James Roger Harman, Gig Harbor, WA (US)

( * ) Notice: Subject to any disclaimer, the term of this patent is extended or adjusted under 35 U.S.C. 154(b) by 560 days.

(21) Appl. No.: 13/484,647

(22) Filed: May 31, 2012

(65) Prior Publication Data

US 2012/0304414 A1 Dec. 6, 2012

Related U.S. Application Data

(60) Provisional application No. 61/519,842, filed on May 31, 2011.

(51) Int. Cl.
*A47L 5/38* (2006.01)

(52) U.S. Cl.
CPC ..... *A47L 5/38* (2013.01); *Y10T 137/8376* (2015.04)

(58) Field of Classification Search
CPC ... A47L 5/38; A47L 9/02; A47L 9/244; A47L 9/242; A47L 5/14; A47L 9/0036; Y10T 137/8376
USPC ..... 15/314, 315, 328, 339, 414; 134/21
See application file for complete search history.

(56) References Cited

U.S. PATENT DOCUMENTS

| | | | | |
|---|---|---|---|---|
| 3,023,447 | A * | 3/1962 | Senne | A47L 5/38 15/314 |
| 3,353,996 | A * | 11/1967 | Hamrick | A47L 5/38 134/21 |
| 3,593,363 | A | 7/1971 | Hamrick | |
| 3,682,500 | A * | 8/1972 | Hamrick | 285/7 |
| 4,336,427 | A | 6/1982 | Lindsay | |
| 4,688,596 | A | 8/1987 | Liebmann | |
| 4,895,528 | A | 1/1990 | Choiniere | |
| 5,526,842 | A | 6/1996 | Christensen | |
| 6,459,056 | B1 | 10/2002 | Graham | |
| 7,010,829 | B2 * | 3/2006 | Harman | A47L 5/38 15/314 |
| 2008/0092323 | A1 * | 4/2008 | Smith | A47L 5/38 15/314 |

* cited by examiner

*Primary Examiner* — Robert Scruggs
(74) *Attorney, Agent, or Firm* — Thomas E. LaGrandeur

(57) ABSTRACT

A retractable hose vacuum cleaning system comprising a retractable vacuum hose configured to retract through a dual port valve assembly, into a system vacuum tube responsive to the vacuum communicated from a vacuum source. The dual port valve assembly comprising one port adapted to receive the full length of a retractable vacuum hose into a system vacuum tube for storage, a second port adapted to connect to the hose end fitting and supply electrical grounding, electrical power and vacuum to the hose for use, valve seals to stop air flow through the port that is not in use and a third port to connect the valve to the system vacuum source. The dual port valve assembly also comprises a debris trap.

20 Claims, 11 Drawing Sheets

DUAL PORT VALVE ASSEMBLY AND RETRACTABLE HOSE CENTRAL VACUUM CLEANING SYSTEM

This application claims the benefit of U.S. Provisional Application No. 61/519,842 filed May 31, 2011.

FIELD OF THE INVENTION

The present invention relates, generally, to vacuum cleaning systems. More particularly, the invention relates to central vacuum systems of the type having retractable suction hoses and valve assemblies that permit the hose to be moved into retractably stored position in the system vacuum tubing connecting the valve assembly to the central vacuum source.

BACKGROUND

Central vacuum cleaning systems are well known and have been available for many years. One early design is 15 U.S. Pat. No. 3,593,363 issued in 1972 disclosing a central vacuum cleaning system using a retractable hose. The inserted end of the hose has a compressible annular seal. The hose is pulled out of the suction conduit located in a wall or floor until the foot end or inserted end reaches the receptacle mounted on the floor or wall, at which time the annular seal on the hose engages a corresponding annular abutment at the receptacle to hold the hose in position and seal between the hose and the receptacle. Accordingly, this design requires that the full length of the hose be pulled out prior to the user using the vacuum.

In 1987, U.S. Pat. No. 4,688,596 issued disclosing a wall outlet box for a control vacuum system that connects to a vacuum hose. The '596 design does not provide any hose storage, or retractable hose features.

In 1990, U.S. Pat. No. 4,895,528 issued disclosing a hose-to-wall fitting for a central vacuum system. Like the earlier '596 reference, the features of the '528 patent were directed to a hose connection fitting only.

Later, in 1996, U.S. Pat. No. 5,526,842 issued to Christensen disclosing a motorized hose wind-up mechanism that requires a somewhat complicated and expensive mechanism for the operation thereof.

While most of the above noted central vacuum system designs include features that are useful in the task to perform the debris vacuum removal process, they typically do not provide a simple, quick way of deploying a long vacuum hose to a selected length. In addition, these designs do not address the problems associated with convenient storage of such long hoses.

Accordingly, a need remains for a central vacuum cleaning system that is easy to install, and facilitates ease of deployment of the vacuum hose therein, and ease of storage of the same following the use of a long vacuum hose to quickly clean large areas.

There is a recognized problem in the central vacuum cleaning industry with vacuum hose management. Typical vacuum hoses are 10 to 50 feet long; difficult to coil up, unwieldy to carry from room to room and bulky to store. Such central vacuum cleaning systems having retractable suction hoses and hose-retracting valve assemblies, that use vacuum suction to retract the hoses back into the system type vacuum plumbing, such as U.S. Pat. No. 7,010,829 B2 issued to Harman in 2006, provide a solution to this problem but heretofore have never been provided with the means to provide an electrical grounding path from the vacuum hose receptacle to the operator end of a hose equipped with a industry standard grounding conductor.

Furthermore such central vacuum cleaning systems having retractable suction hoses and hose-retracting valve assemblies, that use vacuum suction to retract the hoses back into the system type vacuum plumbing, heretofore have never been provided with the means to provide electrical current along the hose to conventional tools attached to the end of the hose through various types of handles, extensions and fittings.

Furthermore such central vacuum cleaning systems having retractable suction hoses and hose-retracting valve assemblies, that use vacuum suction to retract the hoses back into the system type vacuum plumbing, heretofore have never provided a sharp angle debris trap in the air stream adjacent to the vacuum valve to stop such items as pens, pencils and screw drivers from entering the system.

Furthermore such central vacuum cleaning systems having retractable suction hoses and hose-retracting valve assemblies, that use vacuum suction to retract the hoses back into the system, and whose vacuum plumbing relies on traveling hose end seals or circumferential hose clamps and seals to prevent vacuum leakage and in the latter case to restrain hose movement while using the system. While both of these approaches provide use of the hose at any length extended they leak vacuum suction and their components are subject to wear and fatigue resulting in increased vacuum leakage and eventual failure.

Briefly stated, this improved vacuum system has been achieved by using a dual port vacuum valve which allows the hose to be removed from the system tubing through a hose retraction port on the vacuum valve and the hose end fitting inserted into a vacuum inlet port on the vacuum valve which provides vacuum and electrical connections. The sharp, tight angle between the vacuum valve inlet and connection ports forms a debris trap. The moving hose end seal and circumferential hose clamp and seal described in U.S. Pat. No. 7,010,829 have been eliminated reducing the number of moving components thus improving reliability of the system and minimizing vacuum leakage.

SUMMARY OF THE INVENTION

One object of the present invention is to provide a dual port valve assembly for a retractable vacuum hose cleaning system. The dual port valve assembly has two ports that interact with a retractable vacuum hose: a vacuum hose retraction port and vacuum hose inlet port. A third port, the vacuum connection port, connects the valve to vacuum system tubing and the vacuum source of the cleaning system. The vacuum retraction port is configured to allow the retractable hose to be stored in the system tubing, and the vacuum connection port is configured to receive the hose to form a tight seal to allow for use of the hose in vacuum cleaning.

Another object of this invention is to provide a dual port valve assembly that has a conductor in its hose inlet port to provide a path for electrical ground to a retractable vacuum hose. The retractable vacuum hose can either have an attached electrical grounding conductor, such as a wire, or the hose can be made of an electrical grounding material, such as carbon impregnated plastic. Connection of the hose to the conductor in the hose inlet port provides electrical grounding for the hose.

A further object of the instant invention is to provide a dual port valve assembly that has a conductor in its hose inlet port for electrical current from a power source. The conductor is configured to connect with a conductor in a retractable vacuum hose, so that electrical current may be provided through the conductor in the hose to the hose end cuff. Electrical current delivered through the vacuum hose may then be used to power a cleaning tool that attaches to the hose end cuff, and/or to provide control voltage for the system vacuum source. For example, the hose inlet port may contain 2 separate conductors, a higher voltage and lower voltage conductor. Each of these conductors connects to respective higher and lower voltage conductors in the vacuum hose, to provide power via the higher voltage conductor to a cleaning tool that attaches to the hose and to provide power via the lower voltage conductor for controlling operation of the central vacuum source.

The present invention further provides for a dual port valve assembly for a vacuum cleaning system in which the valve assembly has a debris trap. The debris trap is formed by an angle between the axis of the vacuum hose inlet port and the axis of the vacuum connection port.

Another object of this invention is to provide an improved vacuum cleaning system whereby an electrical current path is provided from the receptacle and along the hose to the operator end of the hose so as to provide a grounding path for static electricity. Typically, such hose is pre-wound with an electrical conductor fitted within its flexible coils.

A further object of this invention is to provide an improved vacuum cleaning system whereby electrical current is supplied to the hose from the receptacle and along the hose so as to provide current to cleaning tools at the operator end of the hose. Typically, such hose is pre-wound with electrical wires fitted within its flexible coils.

Yet another object of this invention is to provide an improved vacuum cleaning system whereby there is a tight angle debris trap in the air stream in or adjacent to the vacuum valve to capture such objects as pens, pencils and screwdrivers and prevent them from entering the vacuum system plumbing.

BRIEF DESCRIPTION OF THE DRAWINGS

Some of the objects of the invention having been stated, other objects will appear as the description proceeds when taken in connection with the accompanying drawings, in which.

DETAILED DESCRIPTION OF THE PREFERRED EMBODIMENTS

Figure 1:
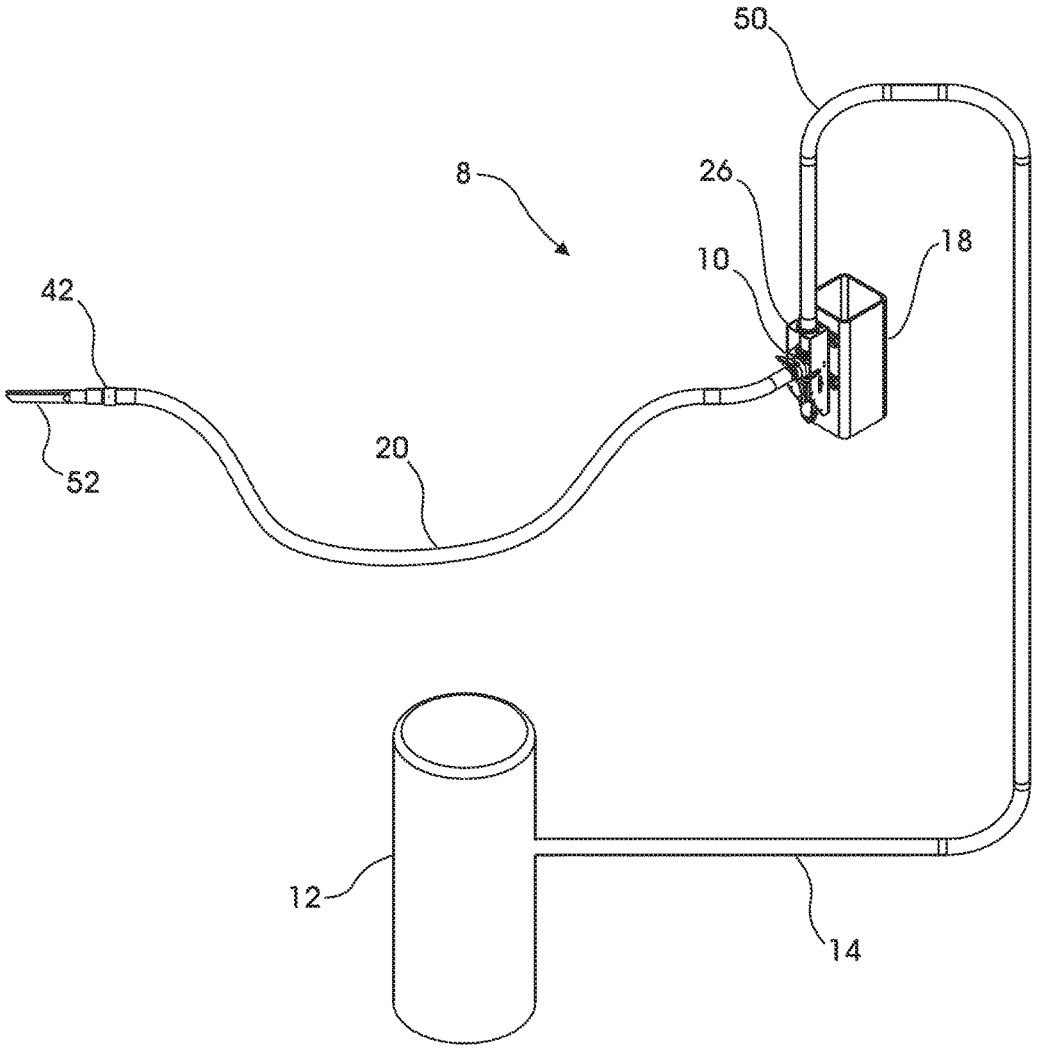
FIG. 1 is a schematic perspective view of one embodiment of the improved vacuum cleaning system wherein the central vacuum source is connected via system vacuum tubing to one or more valve assemblies known in the industry as a "valve" that provide for a vacuum hose to be removed from the system vacuum tubing and vacuum valve assembly through one port and the hose end fitting inserted into a second port that provides vacuum and an electrical grounding path.

Referring more specifically to the drawings, FIG. 1 is one embodiment of the improved vacuum cleaning system 8 of this invention which comprises a vacuum cleaning system of the type having a retractable suction hose 20, a dual port valve assembly 10 and a central vacuum source 12. A plurality of valve assemblies such as valve assembly 10 may be installed in the vacuum cleaning system and may be positioned at various locations in the building.

The system utilizes industry standard vacuum plumbing with minor exceptions. Enlarged radius elbows 50 are required to allow the hose to pass through the bends in the system vacuum tubing for hose storage. A valve housing 26 is required to support the dual port vacuum valve and port seals and for sealing and restraining the tool end of the vacuum hose when in the stored position. Valve assembly 10 is communicatively connected by suitable system vacuum tubing 14 fitted with large radius elbows such as elbow 50 to facilitate hose storage and connected to the inlet of vacuum source 12.

Valve assembly 10 is preferably formed with a suitable open or unsealed valve housing 26 that may be installed on a column 18, wall or other structure as is shown in FIGS. 1, 2, 3 and 4. Valve assembly 10 is configured so it can be removed from its mounted position for servicing and replacement without altering the building structure or the vacuum system plumbing.

Figure 2:
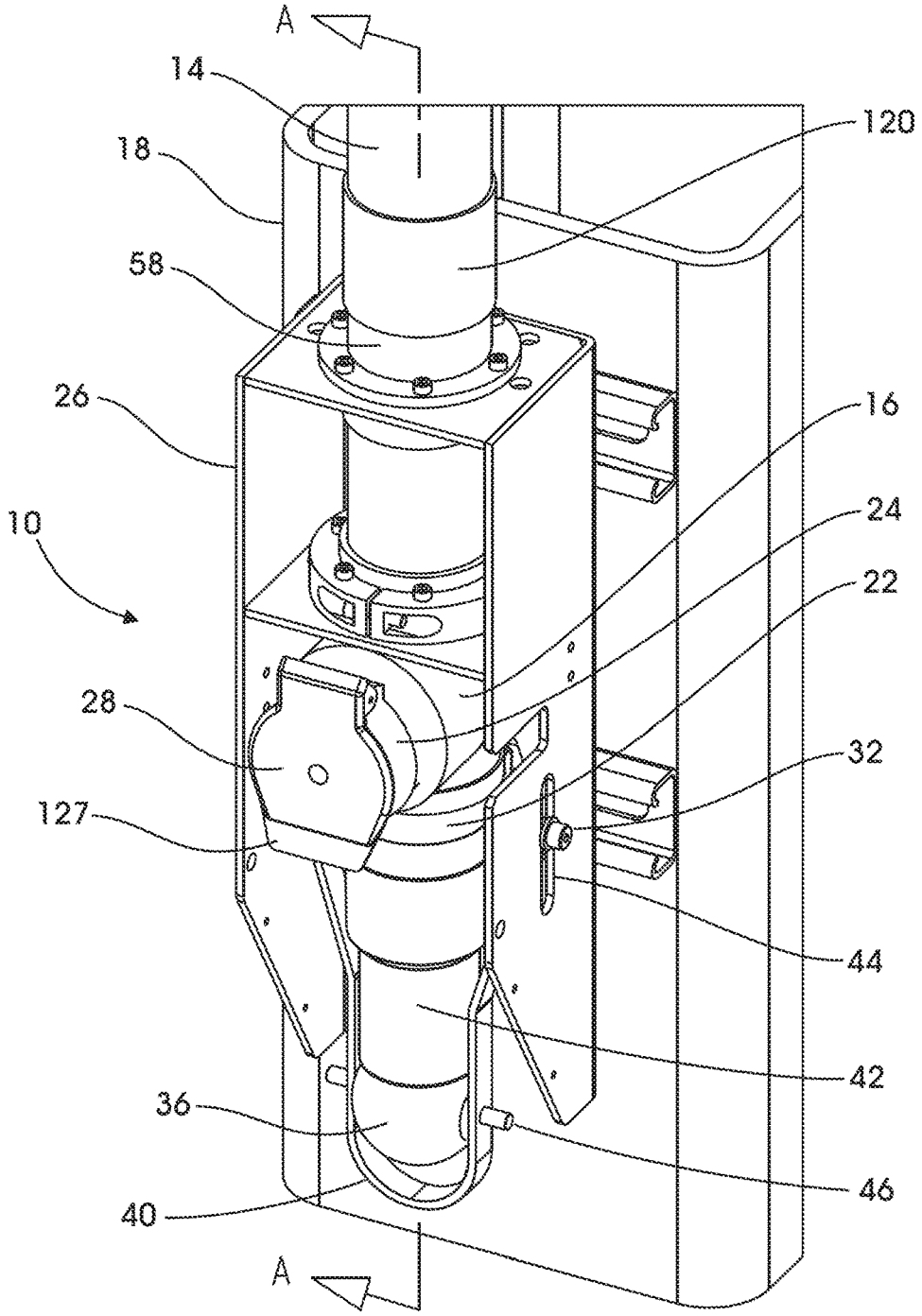
FIG. 2 is an enlarged perspective view of the valve assembly mounted on a column or other structure showing the open or unsealed valve housing configuration, the dual port valve assembly, the vacuum hose with grounding conductor in the stored position with the hose cuff ball seal in place. The vacuum inlet port seal is closed.
Figure 3:
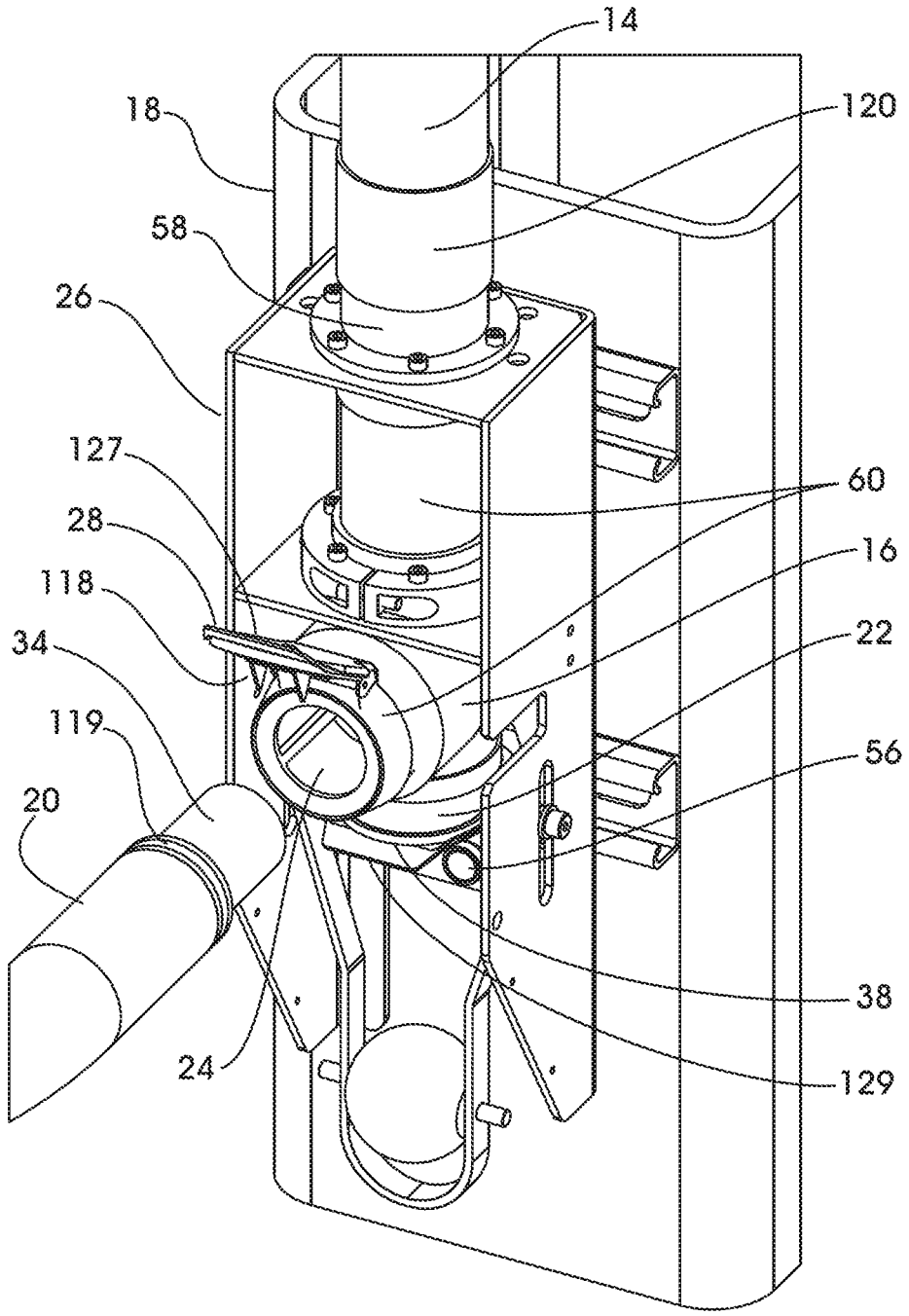
FIG. 3 is an enlarged perspective view of the vacuum valve assembly mounted on a column or other structure showing an open valve housing configuration, the dual port vacuum valve assembly and the vacuum hose with grounding conductor, end fitting ready for insertion into the vacuum inlet port. Hose retraction port seal is closed.

FIGS. 2 and 3 are enlarged views of vacuum valve assembly 10. For system operation the vacuum hose 20 shown in FIG. 3 is extracted from storage by pulling down and pushing back on spring loaded ball seal yoke 40 shown in FIG. 2, which is moveably attached to housing 26 by ball seal yoke guide pin 32 in a travel slot 44 in each side of housing 26, to remove the ball seal 36 from the end of the hose end cuff 42. Ball seal 36 is mounted on yoke 40 by way of ball seal shaft 46. By releasing the ball yoke seal, it will move upwards behind hose end cuff 42 and out of the way. The hose end cuff 42 is grasped and pull downward and the full length of the hose is extracted. The operator then grasps finger tab 129 on hose retraction port seal 38, better shown in FIG. 4, pulling it away from magnetic latch 56 and moves the seal to the closed position. Port seal 38 is typically spring loaded in the closed position but can be held in either its open or closed positions by springs, latches or other mechanisms.

The operator then grasps finger tab 127 shown in FIG. 2 on vacuum inlet port seal 28 with one hand and holds it open while inserting the hose end fitting 34 into vacuum inlet port 24 as shown in FIG. 3. Vacuum inlet port seal 28 is then allowed to rest on hose end fitting 34. Hose retention hook 118 on vacuum inlet port seal 28 is permitted to engage hose retention groove 119 on hose end fitting 34 preventing the hose from being accidentally pulled from vacuum inlet port 24. Vacuum inlet port seal 28 is normally spring loaded closed but can be held in its open and closed positions by springs, latches or other mechanisms.

Figure 4:
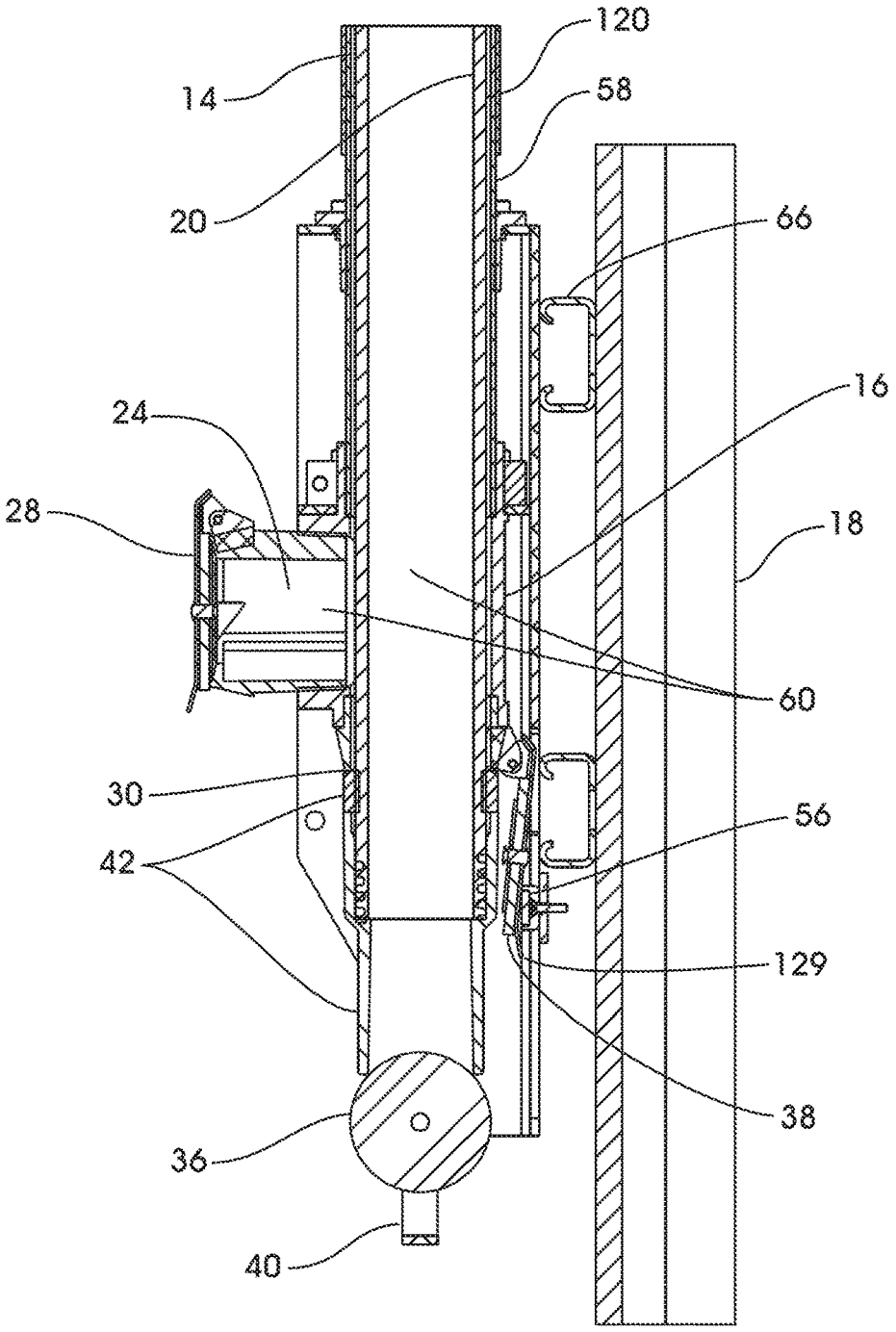
FIG. 4 is an enlarged fragmentary horizontal sectional view taken along line A-A in FIG. 3 showing the open housing configuration and valve assembly mounted on a vertical column or other structure and the vacuum hose with grounding conductor in the stored position.

As best shown in FIGS. 2, 3, and 4, vacuum inlet port 24 is oriented at a 90 degree angle to the axis of vacuum connection port 58 to form a sharp angle debris trap 60. It can be oriented at an angle greater than 90 degrees if desired. However this will result in a more shallow angle in the debris trap decreasing its effectiveness in stopping foreign objects.

The vacuum tool 52 can be attached to the vacuum hose end cuff 42 as shown in FIG. 1 and the vacuum unit 12 can be turned on. The vacuum cleaning system is now ready to use in the conventional manner as shown in FIG. 1.

Hose end fitting 34 and vacuum inlet port 24 shown in FIG. 3 must be made from electrically conductive materials or contain electrical conductors that connect and provide a suitable path to ground. Hose end fitting 34 or its conductor are electrically connected to the conductor in vacuum hose 20 using industry standard techniques.

When the operator is finished with the vacuuming task, cleaning tool 52 is removed from hose end cuff 42. Cleaning tool 52 must be made from an electrically conductive material or contain suitable conductors that connect to hose cuff 42. Vacuum hose 20 is retracted and stored by first grasping finger tab 129 on hose retraction port seal 38 shown in FIG. 3 and moving it to and securing it in the open position with magnetic latch 56. The latched position is shown in FIG. 4. This bleeds suction away from the vacuum inlet port 24.

The operator then grasps finger tab 127 shown in FIG. 3 on vacuum inlet port seal 28 and lifts up slightly with one hand, releasing hose retention hook 118 from hose retention groove 119 and pulls the hose end fitting 34 from vacuum inlet port 24 with the other hand. The vacuum inlet port seal 28 is then moved to the closed position.

Hose end fitting 34 can be inserted into hose retraction port 22, which is now open as shown in FIG. 4, on the vacuum valve 16 and the system suction draws the hose 20 through the vacuum valve and into the system plumbing 14 until the hose end cuff 42 contacts retraction port lip 30 on retraction port 22 and stops as shown in FIGS. 2 and 4. The rate of hose retraction can be varied by restricting the air flow into hose end cuff 42 with the operator's hand or other air restriction device.

The operator then grasps ball seal yoke 40 pulling downward and forward seating ball seal 36 over the open end of hose end cuff 42. The spring loaded ball 36 forms a seal on one of hose cuff 42 and forces the opposite end of hose cuff 42 against retraction port lip 30 forming a seal. Hose retraction and storage are now complete as shown in FIG. 4 and the operator may turn off vacuum unit 12 or leave it on depending on overall configuration and usage of the vacuum system.

This system may be configured with a vacuum valve assembly that does not provide a path to electrical ground and a vacuum hose that does not contain an electrical grounding conductor.

This system may be configured with a vacuum valve assembly that supplies electrical current to the vacuum inlet port, a vacuum hose containing electrical conductors and hose end fittings with electrical connectors to provide electrical current to a vacuum cleaning tool and provide control voltage for the vacuum unit 12 in a manner similar to that shown in FIGS. 5, 6, 7 and 8.

Another embodiment of the improved vacuum cleaning system in this invention is shown in FIGS. 5, 6, 7 and 8 and comprises a vacuum cleaning system 62 of the type having a retractable suction hose 64, a dual port valve assembly 80 in a sealed housing and a central vacuum source 12. A plurality of valve assemblies such as valve assembly 80 may be installed in the vacuum cleaning system 62 and may be positioned at various locations in the building.

The system utilizes industry standard vacuum plumbing with minor exceptions. Enlarged radius elbows 50 are required to allow the hose to pass through the bends in the system vacuum tubing for hose storage and an enlarged valve housing is required to contain the hose clamping/sealing mechanism and for accessing the tool end of the vacuum hose. Valve assembly 80 is communicatively connected by suitable system vacuum tubing 14 fitted with large radius elbows 50 to facilitate hose storage and connected to the inlet of vacuum unit 12.

Valve assembly 80 is preferably formed with a sealed valve housing 102 that may be installed within a standard wall construction between wall surfaces 82 and 82A as shown in FIGS. 5, 6, 7 and 8. Valve assembly 80 may be mounted to wall stud 86 or to wall 82 or 82A and is designed to fit completely into the space inside a standard 2×4 stud wall 82 and 82A through an opening in the wall that is larger, by a clearance gap, than the foot print of the valve housing face flange 116 shown in FIG. 6. Faceplate 109, best shown in FIG. 8, and faceplate seal 112 mount to valve housing face flange 116. Faceplate flange 110 fits flush with outside surface of wall 82A and covers the clearance gap. Door 113 is hinged at door hinge 115 to faceplate 109. Door seal 114 seals housing 102 air tight.

Figure 6:
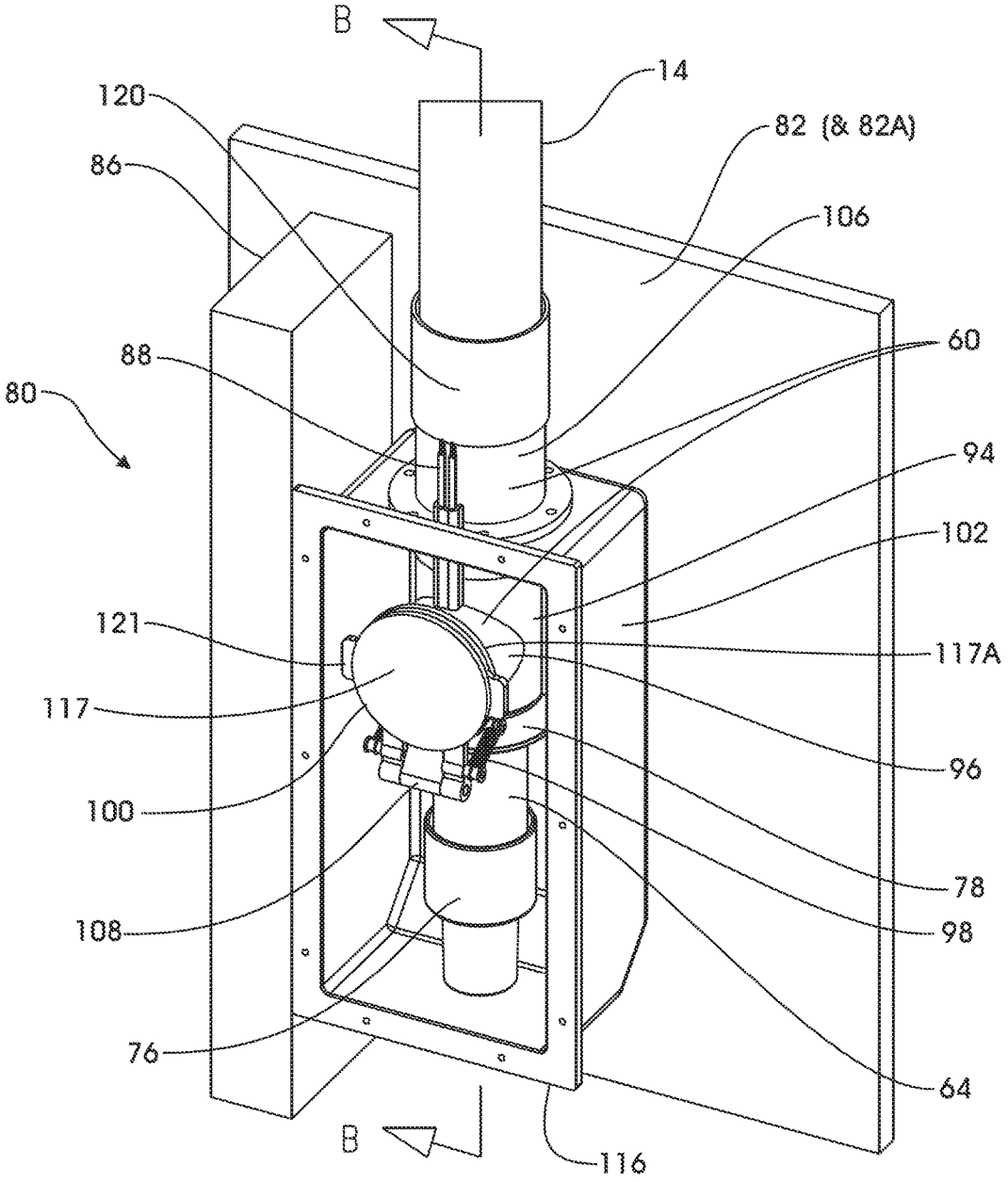
FIG. 6 is an enlarged perspective view of the valve assembly mounted in a vertical wall structure of a building showing the enclosed valve housing configuration, the dual port valve assembly, the vacuum hose with electrical conductors in the stored position. The double faced port seal is positioned to close the electrified vacuum inlet port.
Figure 7:
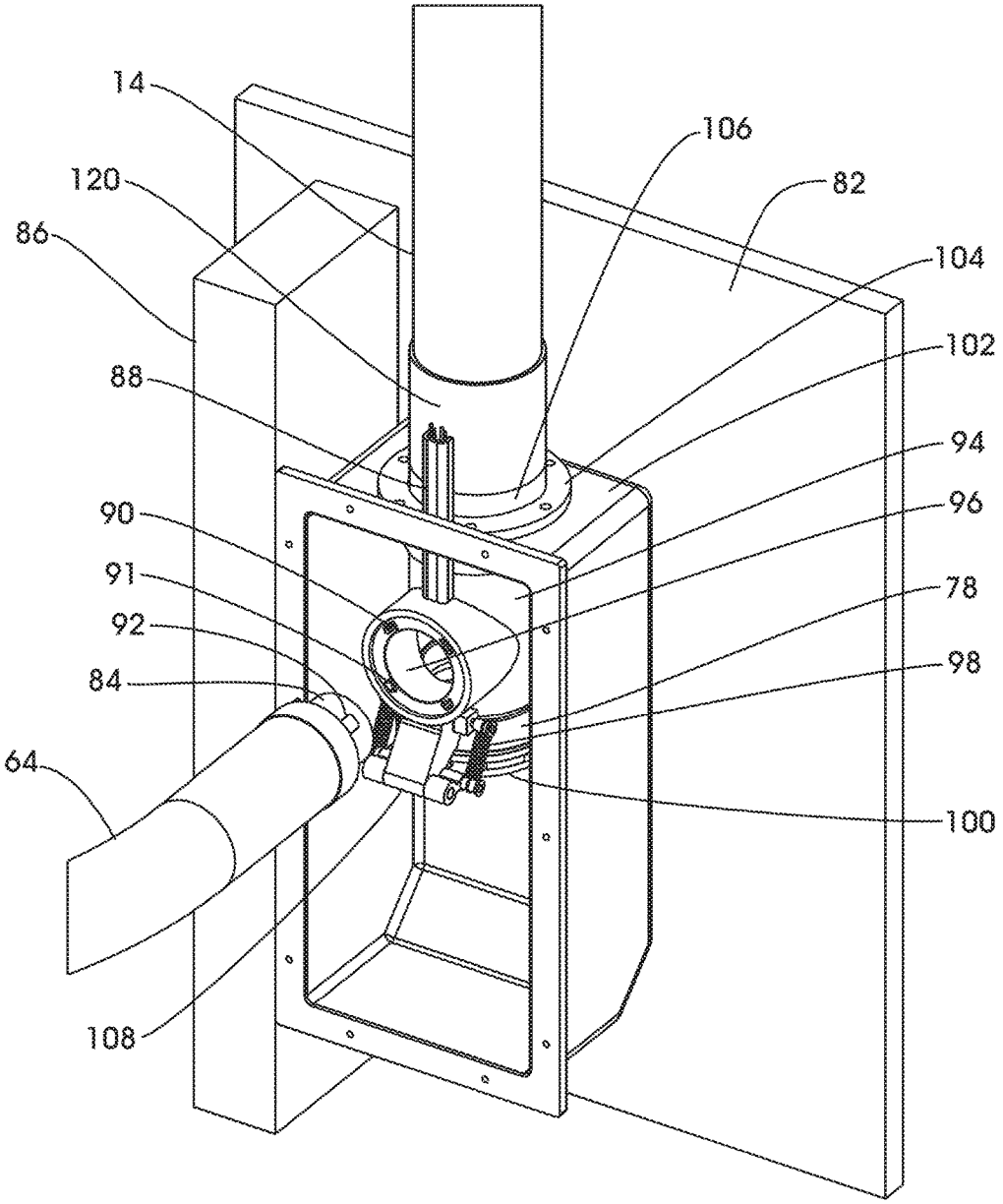
FIG. 7 is an enlarged perspective view of the valve assembly mounted in a vertical wall structure of a building showing the enclosed valve housing configuration, the dual port valve assembly, and the vacuum hose with electrical conductors. The hose is fitted on one end with a hose cuff making electrical contact with the hose conductors and on the other end with a hose end fitting making electrical contact with the hose conductors. The hose end fitting is equipped with electrical and vacuum connectors ready for insertion into the electrified vacuum inlet port.

As shown in FIGS. 6, and 7, vacuum connection port 106 is connected to system vacuum tubing 14 with a suitable vacuum tubing coupling 120 and seal 104 to sealed housing 102.

Figure 8:
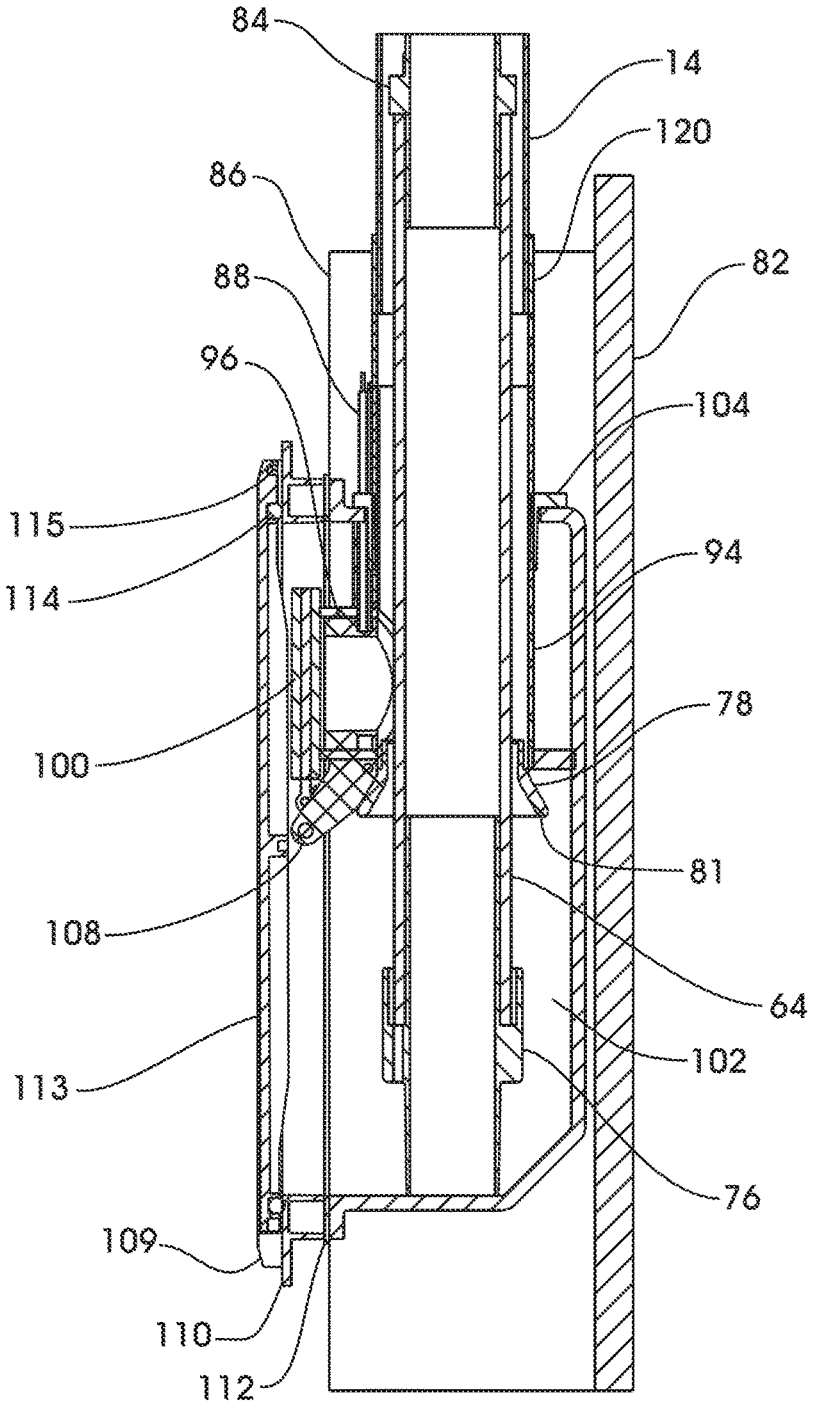
FIG. 8 is an enlarged fragmentary vertical sectional view taken along line B-B in FIG. 6 and showing the sealed housing configuration with door closed and the valve assembly mounted in a vertical wall structure of the building. The vacuum hose is the stored position.

When vacuum hose 64 is in the stored position as shown in FIGS. 7 and 8 double faced port seal assembly 100 is covering and sealing inlet port 96. The end of hose cuff 76 is open but there is no vacuum leakage because door 113 is closed making housing 102 air-tight.

For system operation door 113 is opened and vacuum hose 64 is extracted from the system plumbing 14 through hose retraction port 78 by reaching inside valve housing 102, grasping hose end cuff 76 and pulling down and outward. The full length of the hose must be extracted.

The operator then grasps finger tab 121 on double faced port seal 100 as shown in FIG. 6, which now covers vacuum inlet port 96 with seal face 117A, and pivots the seal over center around seal pivot post 108 until the seal now covers and seals retraction port 78 with seal face 117 leaving vacuum inlet port 96 open.

Double faced port seal 100 typically has a material suitable for sealing attached to both sides forming seal faces 117 and 117A. Double faced port seal 100 has dimensions and geometry which allow it to cover and seal vacuum inlet port 96 in one operating position and hose retraction port 78 in the other operation position when rotated around seal pivot post 108. It is held in either of its two operating positions by over center spring(s) 98. However it can be held in either position by latches, springs or other mechanisms.

Best shown in FIG. 7, the operator then inserts hose end fitting 84 into vacuum inlet port 96 and thereby mates electrical connector 92 on hose fitting 84 with electrical connector 90 in vacuum inlet port 96. Similarly, mating of low voltage electrical connector (not shown) on hose fitting 84 with low voltage electrical connector 91 in vacuum inlet port 96 occurs. High and low voltage is brought to port 96 by way of high and low voltage electrical conductors 88. Hose end fitting 84 orientation is keyed so house and low voltage contacts cannot be crossed. While not shown, a detent or twist lock feature can be employed to prevent accidental extraction of hose end fitting 84 from hose port 96.

Vacuum inlet port 96 is shown in FIG. 7 oriented at a 90 degree angle to the axis of vacuum connection port 106. It can be oriented at an angle greater than 90 degrees if desired. However this will result in a shallower angle in the debris trap decreasing its effectiveness in stopping foreign objects.

Figure 5:
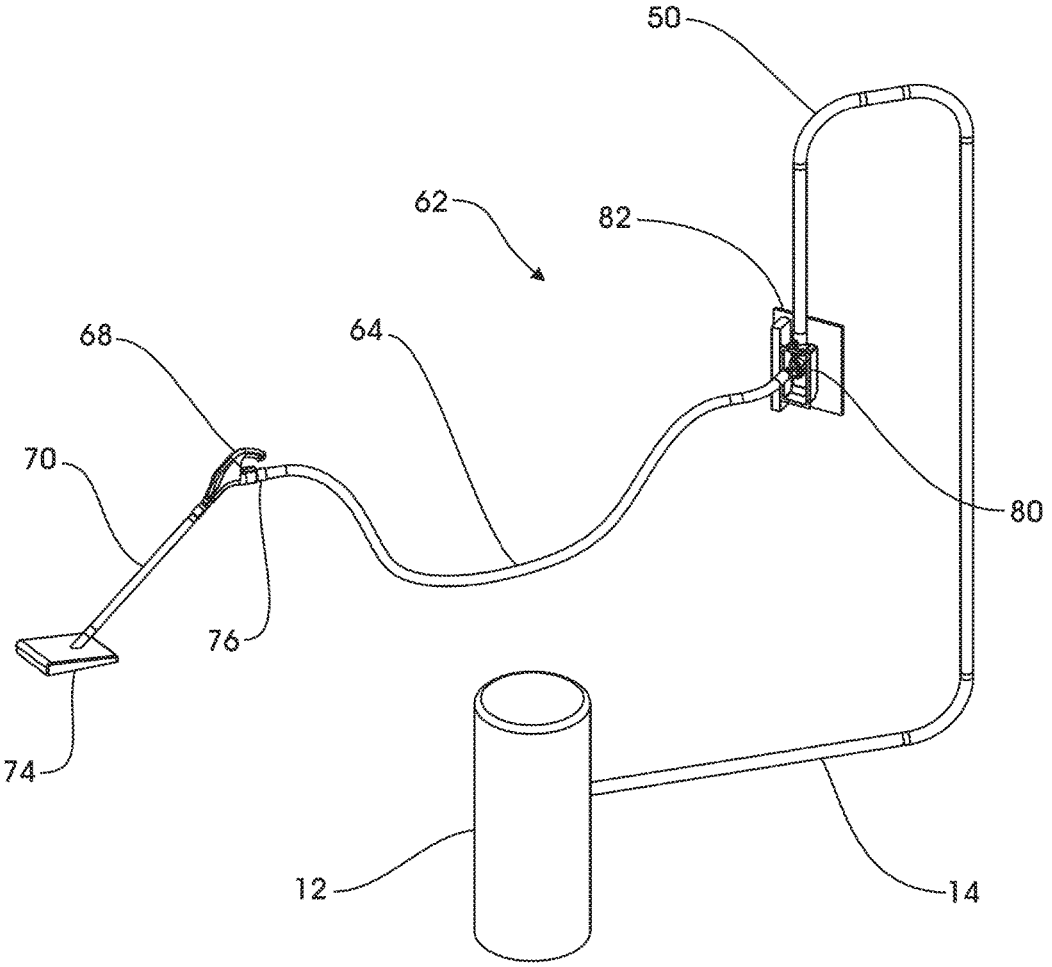
FIG. 5 is a schematic perspective view of one embodiment of the improved vacuum cleaning system wherein the central vacuum source is connected via system vacuum tubing to one or more valve assemblies known in the industry as a "valve" that provide for a vacuum hose to be removed from the system vacuum tubing and vacuum valve assembly through one port and the hose end fitting inserted into a second port that provides vacuum and electrical current.

The operator now attaches hose handle 68 as shown in FIG. 5 to the vacuum hose end cuff 76 which is equipped with electrical connectors to provide electrical current to hose handle 68. Hose handle 68 and wand 70 are equipped with electrical connectors, conductors and switches to provide and control electrical current to vacuum cleaning tool 74. Hose handle 68 is equipped with connectors, conductors and switches to provide control voltage for the vacuum unit 12. Vacuum cleaning system 62 is now ready to use in the conventional manner as shown in FIG. 5.

When the operator is finished with the cleaning task hose handle 68 is removed from hose end cuff 76. Vacuum hose 64 as shown in FIG. 7 is retracted and stored by grasping hose end fitting 84 with one hand, releasing the latching mechanism if used, and pulling it out of vacuum inlet port 96. The operator then pivots double faced port seal 100 around pivot post 108 until the seal face 117 now covers and seals vacuum inlet port 96 leaving hose retraction port 78 open.

The operator then inserts hose end fitting 84 into hose retraction port 78 on the dual port vacuum valve 94 and the system suction draws the hose through the vacuum valve and into the system plumbing 14 until the hose end cuff 76 contacts hose retraction and storage port lip 81 on retraction port 78 and stops as shown in FIG. 7. The rate of hose retraction can be varied by restricting the air flow into hose end cuff 76 with the operator's hand or other air restriction device.

Hose retraction and storage are now complete as shown in FIGS. 7 and 8. The operator then closes door 113 to seal the valve housing and may turn off vacuum unit 12.

Figures 9, 10:
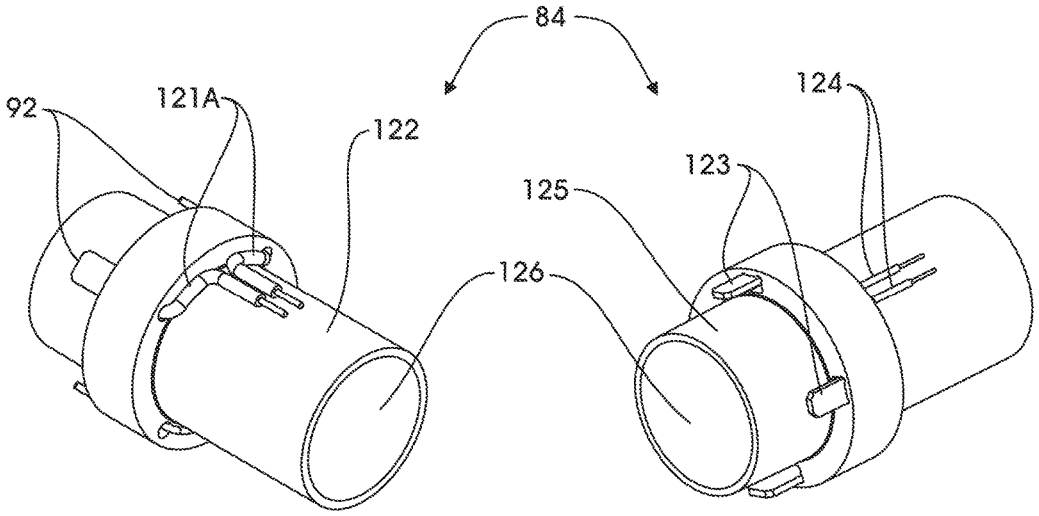
FIG. 9 is an enlarged perspective view of the hose end fitting showing the high voltage electrical connectors and conductors and vacuum connections.
FIG. 10 is an enlarged perspective view of the hose end fitting showing the low voltage electrical connectors and conductors and vacuum connections.

Hose end fitting 84 as shown in FIG. 9 provides high voltage connectors 92 which are electrically attached to conductors 121A which attach to electrical conductors in vacuum hose 64 in FIG. 7. These are used to provide electrical power to an electrical tool at the other end of the hose 64 or handle 68 as shown in FIG. 5.

Hose end fitting 84 as shown in FIG. 10 provides low voltage connectors 123 which are electrically attached to conductors 124 which attach to electrical conductors in vacuum hose 64 in FIG. 7. These provide control voltage to a switch at the opposite end of the hose, handle or tool as shown in FIG. 5 and are used for turning the vacuum source 12 on and off.

Hose end fitting 84 as shown in FIG. 10 also provides a vacuum port connector 125 for connection to vacuum inlet port 96 in FIG. 7. Hose end fitting 84 provides a hose connector 122 as shown in FIG. 9 for connecting to hose 64 in FIG. 7 providing a vacuum passage 126 from vacuum inlet port 96 to hose 64.

Figure 11:
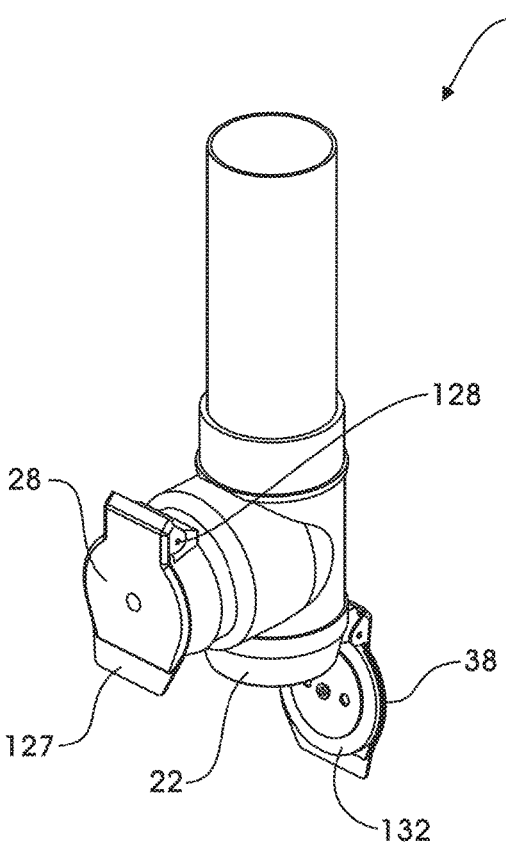
FIG. 11 is an enlarged perspective view of the dual port vacuum valve with 2 single faced seals in the "hose stored" position.

As shown in FIG. 11, the dual port vacuum valve 16 is depicted with single faced port seal 28 and single faced port seal 38 in the "hose stored" position.

Figure 12:
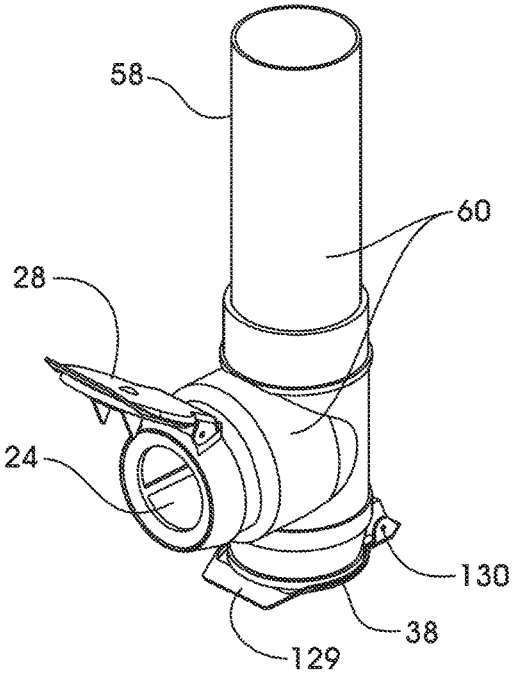
FIG. 12 is an enlarged perspective view of the dual port vacuum valve with 2 single faced seals in the "hose in use" position.

As shown in FIG. 12, the dual port vacuum valve 16 is depicted with single faced port seal 28 and single faced port seal 38 in the "hose in use" position.

Figure 13:
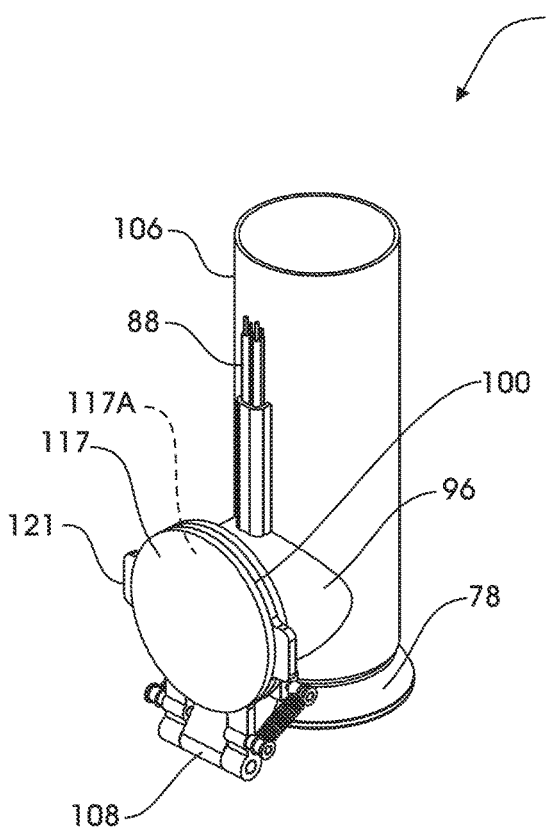
FIG. 13 is an enlarged perspective view of the dual port vacuum valve with a single double faced seal in the "hose stored" position.
Figure 14:
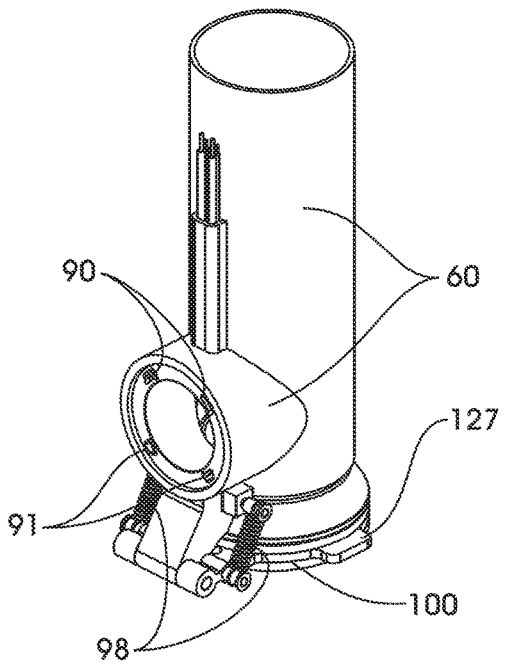
FIG. 14 is an enlarged perspective view of the dual port vacuum valve with a single double faced seal in the "hose in use" position.

Dual port vacuum valve 94 is best depicted in FIGS. 13 and 14.

This system may be configured as a "non-electrified" version with a vacuum valve assembly that supplies vacuum to the inlet port, an electrical path from the vacuum inlet port to ground for static electricity and a vacuum hose that contains an electrical conductor for grounding purposes similar to that shown in FIGS. 1, 2, 3, and 4.

This system may be configured with a vacuum valve assembly that does not provide a path to electrical ground and a vacuum hose that does not contain an electrical grounding conductor.

In the drawings and specifications there have been set forth preferred embodiments of the invention and although specific terms are employed, they are used in a generic and descriptive sense only and not for purposes of limitation. The design of the hose seal and restraint depicted in this invention combine several functions, that of sealing, restraining and wear reduction, into one device or mechanism. Separate devices or mechanisms could be used for each function. Other devices or mechanisms could be used to achieve the functions and results.

In addition, whereas the drawings and specifications relate to central vacuum cleaning systems for a home or building, the application is not limited to this industry alone but to any industry or operation where a vacuum system is used.

Having illustrated and described the principles of my invention in a preferred embodiment thereof, it should be readily apparent to those skilled in the art that the invention can be modified in arrangement and detail without departing from such principles. I claim all modifications coming within the spirit and scope of the accompanying claims.

I claim:

1. A retractable hose vacuum cleaning system comprising:

a retractable vacuum hose having a first tool end with a hose end cuff adapted to removably receive a vacuum cleaning tool, and an opposing second end having a hose end fitting for attaching the hose to a vacuum inlet port;

a dual port valve assembly comprising a vacuum hose retraction port, a vacuum hose inlet port, and a vacuum connection port connected to vacuum system tubing, wherein the ports of the dual port valve assembly are contained in a single valve housing;

the vacuum hose is configurable between a first storage position and a second operating position, wherein when the vacuum hose is positioned in the first storage position the second end of the vacuum hose is located within the vacuum system tubing and the first end is restricted from entering the vacuum hose retraction port and vacuum system tubing;

wherein when the vacuum hose is positioned in the second operating position, the second end of the vacuum hose is completely removed from the vacuum hose retraction port and vacuum system tubing, and is connected to the vacuum hose inlet port, and the first end of the vacuum hose is removably attached to a vacuum cleaning tool;

wherein the vacuum hose retraction port is configured to allow passage of the second end vacuum hose fitting of the second hose end and the vacuum hose through the retraction port for storage of the vacuum hose in the dual port valve assembly and the system vacuum tubing;

wherein the hose retraction port is further adapted to contact the hose end cuff of the first tool end and block passage of the hose end cuff into the hose retraction port for storage of the vacuum hose;

wherein the vacuum hose inlet port is adapted to receive the hose end fitting to form a vacuum seal; and wherein the vacuum connection port is adapted to receive the system vacuum tubing that is in communication with a system vacuum source for creating a vacuum within the system vacuum tubing, with the vacuum communicated to and within the vacuum hose through the hose inlet port.

2. The dual port valve assembly of claim 1 further comprising a port seal on the vacuum hose retraction port and a port seal on the vacuum hose inlet port.

3. The dual port valve assembly of claim 1 further comprising a double face port seal that is adapted to seal either the vacuum hose retraction port or the vacuum hose inlet port when one of the ports is not in use.

4. The dual port valve assembly of claim 1 in which the valve housing is an unsealed valve housing.

5. The dual port valve assembly of claim 1 in which the valve housing is a sealed valve housing.

6. The dual port valve assembly of claim 1 further comprising a debris trap formed as a sharp angle between the axis of the vacuum hose inlet port and the axis of the vacuum connection port.

7. The retractable hose vacuum cleaning system of claim 1 wherein the retractable vacuum hose further comprises a conductor for electrical ground from the hose cuff to the hose end fitting;

wherein the vacuum hose inlet port further comprises a conductor for electrical grounding;

wherein the hose end fitting and hose inlet port are further adapted to mate with each other through electrical connectors so as to connect the vacuum hose and hose inlet port conductors to provide a path for electrical ground for the vacuum hose; and wherein vacuum hose portion that attaches to the vacuum hose inlet port and comprises the electrical grounding conductor is adapted to pass through the retraction port for storage in the dual port valve assembly.

8. The retractable hose vacuum cleaning system of claim 1 wherein the retractable vacuum hose further comprises an electrically conductive hose;

wherein the vacuum hose inlet port further comprises a conductor for electrical grounding and wherein the hose inlet port is further adapted so as to connect the retractable vacuum hose and hose inlet port conductor to provide a path for electrical ground for the retractable vacuum hose.

9. The retractable hose vacuum cleaning system of claim 1 wherein the retractable vacuum hose further comprises a conductor for electrical current from the hose end cuff to the hose end fitting;

wherein the vacuum hose inlet port further comprises a conductor for electrical current from a power source, the conductor positioned outside of the vacuum hose inlet port portion that receives the hose end fitting to form a vacuum passage; and wherein the hose end fitting and hose inlet port are further adapted to mate with each other through electrical connectors positioned outside of the hose end fitting and hose inlet port portions that mate to form a vacuum passage so as to connect the vacuum hose and hose inlet port conductors and provide an electric current from the power source at the hose end cuff; and wherein vacuum hose portion that attaches to the vacuum hose inlet port and comprises the electrical conductor is adapted to pass through the retraction port for storage in the dual port valve assembly.

10. The retractable hose vacuum cleaning system of claim 9 wherein the electric current is supplied to the vacuum cleaning tool.

11. The retractable hose central vacuum cleaning system of claim 9 wherein the electric current is supplied to the vacuum cleaning tool and to provide control voltage for the central vacuum source.

12. The retractable hose central vacuum cleaning system of claim 9 wherein the electric current is supplied to provide control voltage for the system vacuum source.

13. A dual port valve assembly for a retractable hose vacuum cleaning system comprising a vacuum hose retraction port, a vacuum hose inlet port, and a vacuum connection port that is attached to vacuum system tubing, wherein the ports of the dual port valve assembly are contained in a single valve housing;

wherein the ports of the dual port valve assembly are configured to interact with a retractable vacuum hose of the retractable hose vacuum cleaning system;

wherein the vacuum hose includes first and second opposing ends and is configurable between a first storage position and a second operating position, wherein when the vacuum hose is positioned in the first storage position the first end of the vacuum hose is located within the vacuum system tubing and the second end is external to and in contact with the vacuum hose retraction port, and wherein when the vacuum hose is positioned in the second operating position, the first end of the vacuum hose is completely removed from the vacuum hose retraction port and is connected to the vacuum hose inlet port and the second end of the vacuum hose is removably attached to a cleaning tool.

14. The dual port valve assembly of claim 13 further comprising a port seal on the vacuum hose retraction port and a port seal on the vacuum hose inlet port.

15. The dual port valve assembly of claim 13 further comprising a double faced port seal that is adapted to seal either the vacuum hose retraction port or the vacuum hose inlet port when one of the ports is not in use.

16. The dual port valve assembly of claim 13 in which the valve housing is an unsealed valve housing.

17. The dual port valve assembly of claim 13 in which the valve housing is a sealed valve housing.

18. The dual port valve assembly of claim 13 further comprising a debris trap formed as a sharp angle between the axis of the vacuum hose inlet port and the axis of the vacuum connection port.

19. The dual port valve assembly of claim 13 further comprising a conductor in the vacuum hose inlet port adapted to provide an electrical ground path to a retractable vacuum hose when the vacuum hose is attached to the vacuum hose inlet port and the vacuum hose comprises an electrical grounding conductor, wherein vacuum hose portion that attaches to the vacuum hose inlet port and comprises the electrical grounding conductor is adapted to pass through the retraction port for storage in the dual port valve assembly.

20. The dual port valve assembly of claim 13 wherein the vacuum hose inlet port further comprises a conductor for electrical current from a power source, the conductor adapted to supply electric current from the power source to a retractable vacuum hose when the vacuum hose is attached to the vacuum hose inlet port, the conductor positioned outside of the vacuum hose inlet port portion that receives the vacuum hose to form a vacuum passage, and the vacuum hose comprises an electrical current conductor, the electrical current conductor positioned outside of the vacuum hose portion that inserts into vacuum hose inlet port to form the vacuum passage; and wherein vacuum hose portion that attaches to the vacuum hose inlet port and comprises the electrical conductor is adapted to pass through the retraction port for storage in the dual port valve assembly.

* * * * *